US005645493A

United States Patent [19]

Garcia

[11] Patent Number: 5,645,493

[45] Date of Patent: Jul. 8, 1997

[54] PENDULUM PUTTER

[76] Inventor: Gustavo Garcia, 1944 Turnbull Canyon Rd., Hacienda Heights, Calif. 91745

[21] Appl. No.: 668,736

[22] Filed: Jun. 24, 1996

[51] Int. Cl.[6] ..... A63B 53/04; A63B 53/14

[52] U.S. Cl. ..... 473/203; 473/336; 473/341; 473/409; 473/300

[58] Field of Search ..... 473/243, 256, 473/251, 293, 300, 340, 313, 314, 203, 204, 341, 334, 335, 336, 337, 338, 339, 291, 409

[56] References Cited

U.S. PATENT DOCUMENTS

| | | | |
|---|---|---|---|
| 1,503,291 | 7/1924 | Rimmer | 473/340 |
| 1,518,316 | 12/1924 | Ellingham | 473/337 |
| 2,801,106 | 7/1957 | Koehler | 473/295 |
| 2,826,417 | 3/1958 | Marcoccio | 473/282 |
| 2,843,384 | 7/1958 | Schmidt | 473/204 |
| 3,497,220 | 2/1970 | Scott | 473/313 |
| 3,574,349 | 4/1971 | Kropp | 473/293 |
| 3,679,207 | 7/1972 | Florian | 473/293 |
| 3,954,265 | 5/1976 | Taylor | 473/313 |
| 4,163,554 | 8/1979 | Bernhardt | 473/293 |
| 4,227,694 | 10/1980 | Drake | 473/293 |
| 4,240,636 | 12/1980 | Swenson | 473/293 |
| 4,317,568 | 3/1982 | Green | 473/238 |
| 4,361,329 | 11/1982 | Brock | 473/286 |
| 4,491,323 | 1/1985 | Kozub . | |
| 4,537,403 | 8/1985 | Farina | 473/203 |
| 4,592,552 | 6/1986 | Garber | 473/293 |
| 4,605,228 | 8/1986 | Guendling | 473/293 |
| 4,621,816 | 11/1986 | Leek | 473/293 |
| 4,795,158 | 1/1989 | Kuykendall | 473/340 |
| 5,088,738 | 2/1992 | Mundt et al. . | |
| 5,125,657 | 6/1992 | Beil | 473/293 |

*Primary Examiner*—Sebastiano Passaniti

[57] ABSTRACT

A putter having only one paddle grip (10) at one end of the shaft, allowing finger-tip squeezing of the long flat sides of the grip. Shaft (11) has appropriate surfaces to permit slippery finger and finger-tip holds. A head (12) contains heel (26) and toe (24) cavities with discs (32) to distribute head weight for pendulum putter stroke and plumb control, and to adjust total weight of the putter for comfort. A finger-tip grip methodology permits precise pendulum motion of the putter, minimizing pushing or pulling of the putt.

5 Claims, 4 Drawing Sheets

PENDULUM PUTTER

BACKGROUND

1. Field of Invention

This invention relates to putters, specifically to putters which permit the generation of precise pendulum putts.

2. Description of Prior Art

Increased putting accuracy is essential for improving golf scores. There are uncontrollable and controllable factors affecting such accuracy. Uncontrollable factors are moisture and grain of the grass, wind, and contour of the ground. Controllable factors are the ability of a golfer to compensate for the uncontrollable factors and use existing putters to propel a ball at the right speed and in the desired direction without pushing the ball to the right or pulling it to the left. This push or pull problem is a pesky one for most golfers and some inventors have addressed it with unsuccessful putter designs.

For example, U.S. Pat. No. 5,088,738 to Mr. and Mrs. Mundt (1991) discloses a complex Pendulum Putting Device which permits the generation of precise pendulum strokes. As a putter, this device appears to have the capability of eliminating pushes and pulls by means of a pendulum swing. Unfortunately, the device has moving parts. Such moving parts on a putter do not comply with the Rules of Golf as approved by the United States Golf Association and the Royal and Ancient Golf Club of St. Andrews, Scotland. Therefore, it cannot be used to play golf. Instead, it is being advertised and sold by Mr. Mundt as some sort of training tool.

OBJECTS AND ADVANTAGES

Accordingly, besides the precise pendulum motion advantages of the Pendulum Putting Device described in my above patent, several objects and advantages of the present invention are:

(a) to provide a pendulum putter with only one grip, a paddle, to comply with the Rules of Golf.

(b) to provide a putter which can be swung in a precise pendulum motion with finger-tip control, permitting moving it in the desired direction without pushing or pulling the putt;

(c) to provide a putter with a paddle grip that has two perfectly flat and smooth surfaces parallel to each other, facilitating the pivoting of the putter to obtain a precise pendulum swing with finger-tip control;

(d) to provide a putter whose shaft surfaces are essentially frictionless;

(e) to provide a putter whose head weight can be distributed from toe to heel to permit plumbing the shaft in line with the direction of the stroke for better pendulum balance control;

(f) to provide a putter whose head weight can be distributed from face to back to permit improving plumb-sighting accuracy of the desired ball trajectory regardless of the rotational position of the shaft;

(g) to provide a putter whose total weight can be changed for golfer comfort, and (h) to provide a putter which, when plumbed, has the lowest part of the head on the plumb line to control snagging of the head on the ground during a putt.

Further objects and advantages are to provide a putter that is easy to use and inexpensive to manufacture. Still further objects and advantages will become apparent from a consideration of the ensuing description and drawings.

DRAWING FIGURES

In the drawings, closely related figures have the same number but different alphabetic suffixes.

REFERENCE NUMERALS IN DRAWINGS

Figure 1:
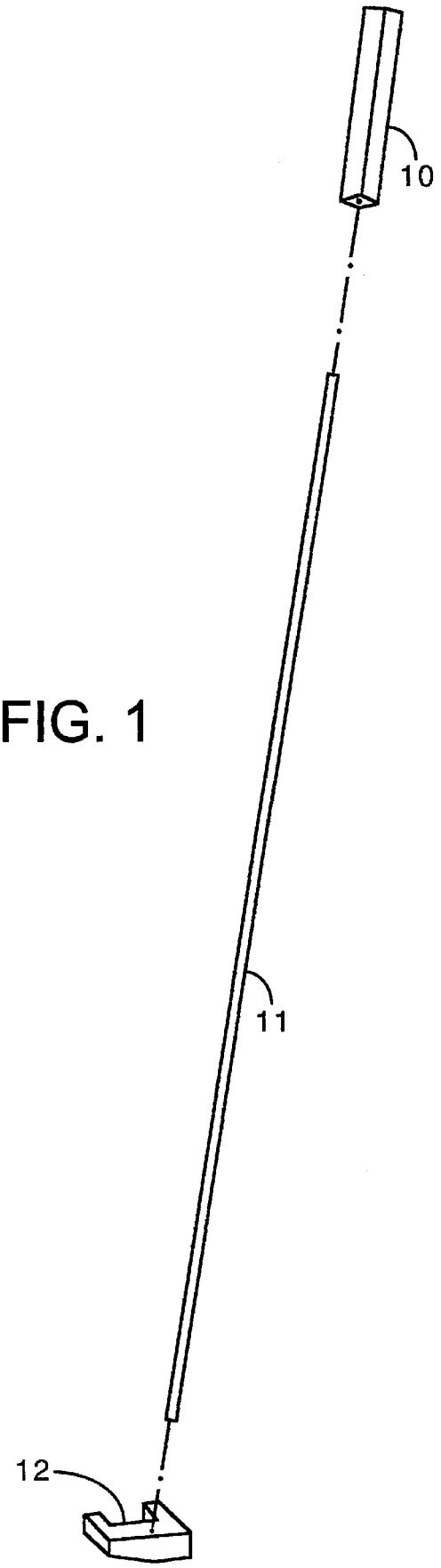
FIG. 1 shows an exploded view of a pendulum putter with a paddle grip.

10 paddle grip
11 shaft
12 head
13 right side of grip
14 left side of grip
16 front side of grip
18 back side of grip
20 hole in grip
22 face of head
24 toe cavity in head
26 heel cavity in head
28 hole in head
30 lowest part of head
32 disc
34 golf ball
36 top view of head
38 foot-prints of golfer
42 desired ball trajectory
44 trajectory of pulled ball
46 direction of back stroke
48 trajectory of pushed ball

DESCRIPTION—FIGS. 1–4

A typical embodiment of the putter of the present invention is illustrated in the exploded view of FIG. 1. The putter consists of a shaft 11, a single paddle grip 10, and a head 12. The larger cross-section of the shaft is embedded in the paddle grip and the head is attached to the other end of the shaft.

The shaft is approximately 50 inches long of varying cross-section that can be solid or consist of a rigid tube. Such shafts are available from several sources including Goldsmith International, Inc. of Austin, Tex. The preferred shafts are made of a material whose outside surfaces can be made essentially frictionless. One way to do this is to paint the grasping area with varnish.

Figure 2A:
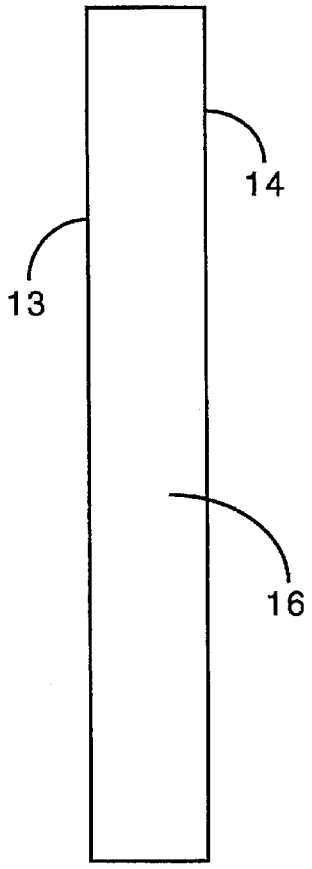
FIG. 2A is a from view of a paddle grip.
Figure 2B:
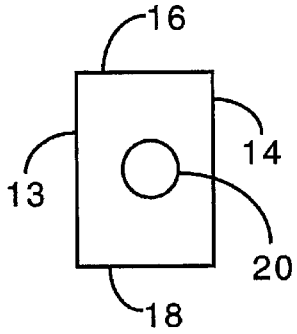
FIG. 2B is a bottom view of a paddle grip.

A typical embodiment of the paddle grip is illustrated in FIG. 2A (front view) and FIG. 2B (bottom view). The grip has a hole 20 filled by the shaft when the putter is assembled. A right side 13 and a left side 14 of the grip are precisely parallel to each other and to the axis of the shaft. Both sides are perpendicular to a face 22 of the head. A front side 16 of the grip and a back side 18 are flat. In the preferred embodiment, the grip is made of rubber. However, the grip can consist of any other material such as leather that can be flexed without fracturing, various impregnated or laminated fibrous materials, etc. A conventional paddle grip is sold under the Bullet label and is made of rubber. It has three flat sides and a rounded one.

Figure 3A:
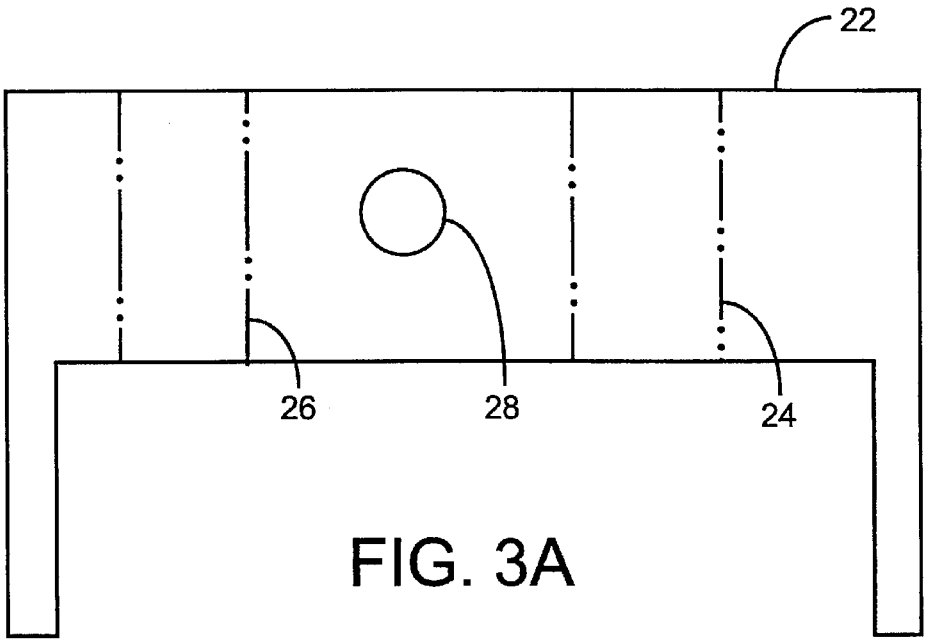
FIG. 3A shows a top view of a putter head.
Figure 3B:
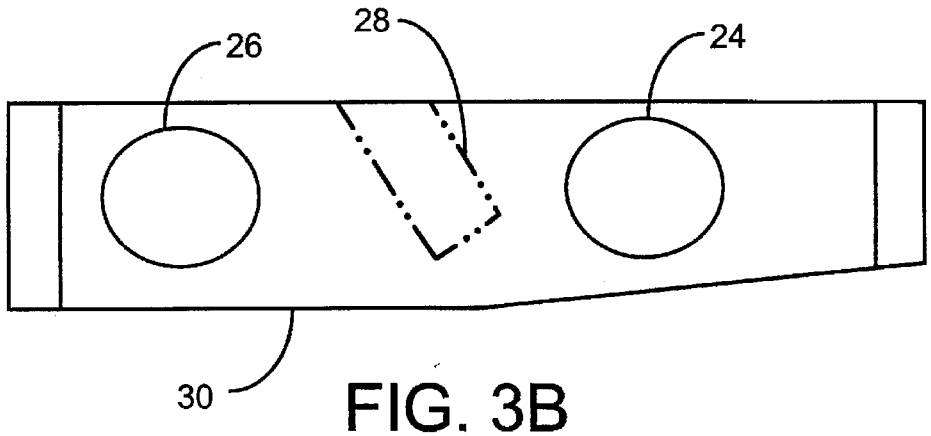
FIG. 3B is a back view of a putter head.
Figure 4:
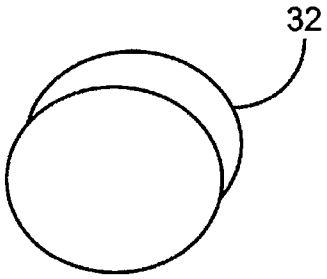
FIG. 4 shows a disc, several of which are placed in the head cavities to distribute and change the weight of the putter.

A typical embodiment of the head is illustrated in FIG. 3A (top view) and FIG. 3B (back view). The face is typically 4 inches wide and 1 inch high. The solid base is 1 inch in depth and the sides of the head extend another inch. FIG. 4 illustrates disc 32, several of which fit in a cavity 24 and a cavity 26 of the head.

A point 30 on the head is the lowest part of the putter when it is plumbed, in line with the axis of the shaft. The head has a hole 28 which is penetrated and filled with an end of the shaft when the putter is assembled. The cavities are filled to capacity with light and heavy discs as needed to position the shaft vertically when the putter is plumbed. Both discs are used to change the weight and also to distribute it along the axis of the cavities and between the two cavities. The light disc is made of plastic. The heavy disc is made of lead. However, the discs can consist of other heavy or light materials.

A vertical shaft is necessary since the desired trajectory of the ball is partly determined sometimes by plumbing the putter before addressing the ball. Such determination is done by standing behind the ball and holding the putter by the grip while lining the shaft with the ball. The lateral distance seen from the hole to a point in line with the shaft is mentally noted. If the hole is right of the shaft, the desired trajectory is to aim left of the hole a distance equal to that seen in the sighting. If the hole is left of the shaft, the ball is aimed to the right of the hole. If the hole lines up with the shaft, a putt aimed straight for the hole is desired. The accuracy of the plumb is improved if the center of gravity of the putter is in line with the axis of a vertical shaft.

OPERATION—FIGS. 1, 2, 3, 4, 5

Figure 5:
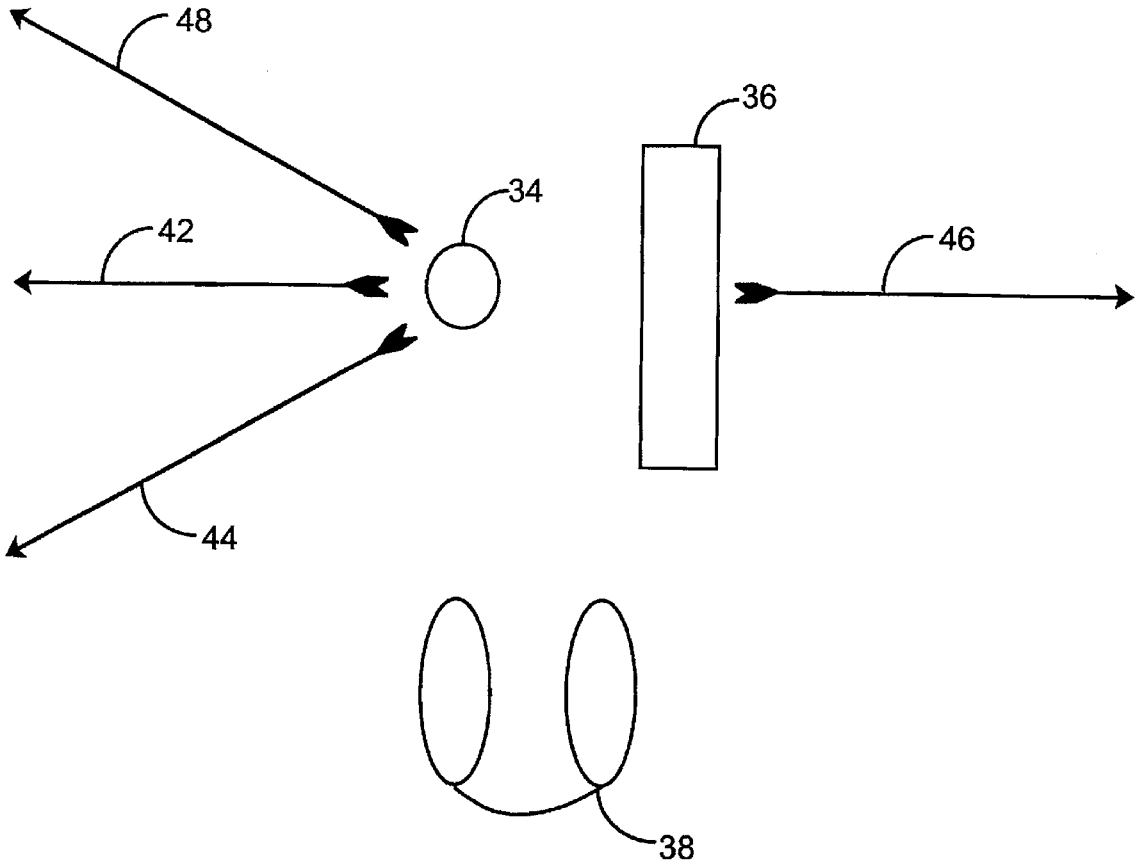
FIG. 5 shows a view of a putting green as seen by a golfer addressing a ball to putt and depicts possible ball trajectories.

A conventional long-shafted putter strikes a golf ball with a non-pendulum swing. FIG. 5 shows a top view of a right-handed person standing over a ball 34 while lining the face of a head 36 perpendicular to a desired direction 42 of travel for the ball. The left hand holds a round grip and the right hand also holds a round grip at mid-shaft such that the shaft makes a 10 degree angle with the vertical axis. The putter is swung to a rear 46 of the ball and back in non-pendulum motion to strike the ball and hopefully propel it along a desired trajectory 42. Unfortunately, such an operation can lead to a push, propelling the ball to a right 40 of the desired trajectory; or a pull, sending the ball to a left 44 of the desired direction. The pendulum putter of the present invention can also be used in this manner to obtain the same results. However, the pendulum putter can also be used to permit precise pendulum putts without pushing or pulling the ball away from the desired direction.

In addressing the ball with a pendulum putter, foot-prints 38 of the golfer are placed as close to the ball as possible on a line parallel to the desired trajectory of the ball. The ball is below the eyes. The body is in a slightly open position, facing sufficiently behind the ball to allow the right hand to swing freely.

The preferred manner of holding the pendulum putter to prevent pushing or pulling involves firmly holding the paddle grip by placing the thumb-tip of the left hand on the left side of the grip (the side next to the body for a right-handed golfer) and placing the tip of the index finger on the right side of the grip. Both finger-tips are near the top of the grip with the end of the shaft inside the grip between them. The thumb and index fingers squeeze the grip and act as a pivot, preventing the shaft from rotating when the putter swings. The right hand extends down the shaft. The thumb and index fingers loosely wrap around the shaft. The shaft presses down on the muscular pad at the base of the thumb and index finger. The little finger is stiff and projects straight down along the shaft. The finger-tip presses against the shaft at a point in line with the desired stroke line. The remaining fingers wrap loosely around the shaft.

The relative position of the ball to the shaft is such that, viewed with the right eye, the ball fills the U made by the knuckles of the thumb and index fingers when the putter is not touching the ground and plumbed. The right arm is the only part of the body that moves as the putter is swung back 46 away from the ball and then brought forward in a pendulum manner. The motion of the putter is always in line with the desired trajectory 42, such line being mostly controlled by the left hand finger-tip pivot on the paddle grip.

SUMMARY, RAMIFICATIONS, AND SCOPE

Accordingly, the reader will see that the pendulum putter of this invention permits precisely striking a golf ball with a pendulum stroke. Use of a pendulum putter helps golfers prevent pushing or pulling the ball. Furthermore, the putter has additional advantages in that it permits more accurate plumbing of the shaft by transferring weight between the toe and heel of the head, a help in generating more accurate pendulum swings; and by transferring weight between the front and back of the head to place the center of gravity closer to the axis of the shaft regardless of shaft rotation. This helps determine more accurately where to aim the putt to account for the expected trajectory (break of the ball) due to the undulations, or lack thereof, of the ground.

it allows customizing the feel of the putter by changing the total weight of the head.

Although the description above contains many specifications, these should not be construed as limiting the scope of the invention but as merely providing illustrations of some of the presently preferred embodiments of this invention. For example, the putter can have a different head, such as a blade head. Also, the paddle grip can have two flat sides with any other combination of flat of rounded short sides. The shaft can be of varying lengths. Thus the scope of the invention should be determined by the appended claims and their legal equivalents, rather than by the examples given.

I claim:

1. A golf putter for putting with a true pendulum swing comprising in combination:

a shaft connected to a generally rectangular head and a generally rectangular grip;

said head having a flat top portion, a non-flat sole portion, a heel, a toe, a ball striking front face and a rear face with two weight receiving circular recesses extending forward from said rear face to said front face, one of said recesses being located close to the heel of said head and the other being located close to the toe of said head, and a plurality of heavy weight discs and light spacer discs adapted to fit snugly in said recesses, whereby said weights may be assembled side-by-side in said cavities to align the center of gravity of said putter with the centerline of said shaft;

said shaft having a mid-shaft ungripping surface and a primary longitudinal axis being divergent from a vertical axis passing through said top portion of said putter head by at least ten degrees;

said grip connected to said shaft and having thumb tip and finger tip gripping surfaces with low contact resistance on two parallel sides.

2. The golf putter of claim 1 which further includes:

said head comprising means to permit precise alignment of the longitudinal centerline of said shaft in a vertical plane when the putter is held at an extending end of said grip for plumb lining, whereby the shaft will be vertical regardless of the rotational orientation of the shaft;

said thumb tip and finger tip gripping surfaces aligned precisely perpendicular to said ball striking front face of the putter.

3. The golf putter of claim 1 wherein the lowest point of said sole portion is in-line with the longitudinal centerline of the shaft when the putter is held by the grip and is plumb lined.

4. A method for increasing the accuracy of a true pendulum swing comprising:

a. providing a golf putter having a shaft connected to a generally rectangular head and a generally rectangular grip;

said head having a flat top portion, a non-flat sole portion, a heel, a toe, a ball striking front face and a rear face with two weight receiving circular recesses extending forward from said rear face to said front face, one of said recesses being located close to the heel of said head and the other being located close to the toe of said head, and a plurality of heavy weight discs and light spacer discs adapted to fit snugly in said recesses, whereby said weights may be assembled side-by-side in said cavities to align the center of gravity of said putter with the centerline of said shaft;

said shaft having a mid-shaft ungripping surface and a primary longitudinal axis being divergent from a vertical axis passing through said top portion of said putter head by at least ten degrees;

said grip connected to said shaft and having a thumb tip gripping surface on one side of said grip and a finger tip gripping surface on another side of said grip parallel to said one side, said thumb tip and finger tip gripping surfaces having a low contact resistance;

b. grasping said thumb tip and said finger tip gripping surfaces with the respective thumb and index finger of the same hand of a golfer, whereby a single point of suspension is provided for a stationary center of motion and a stationary axis of rotation;

c. placing the other hand of a golfer on a portion of the shaft distant from the rectangular grip, whereby the hand on the shaft portion is moved rearwardly and then forwardly in a pendulum motion to strike a golf ball;

d. placing the little finger of the hand indicated in step (c) such that the little finger extends downwardly along the shaft while the shaft is loosely held by the base of the thumb and index finger, and aligning the putter with a golf ball on the ground such that the position of the ball with respect to the shaft, when viewed with the eye of a golfer, allows the image of the ball to fill the U shape made by the spacing between the knuckles of the thumb and index finger of the hand indicated in step (b);

e. whereby the putter may be used by both right and left handed players and the same hand as indicated in step (b) is the left hand for a right handed player and the eye of the golfer as indicated in step (d) is the left eye for a right handed player.

5. The method of claim 4 wherein the same hand as indicated in step (b) is the right hand for a left handed player and the eye of the golfer as indicated in step (d) is the right eye for a left handed player.

* * * * *